United States Patent [19]

Heinrich et al.

[11] Patent Number: 4,769,880

[45] Date of Patent: Sep. 13, 1988

[54] PROCESS FOR THE CONTINUOUS DRAWING AND TEXTURIZING OF FILAMENTS

[75] Inventors: Karl Heinrich, Grossaitingen; Norbert Heichlinger, Königsbrunn, both of Fed. Rep. of Germany

[73] Assignee: Hoechst Aktiengesellschaft, Fed. Rep. of Germany

[21] Appl. No.: 511,636

[22] Filed: Jul. 7, 1983

[30] Foreign Application Priority Data

Jul. 10, 1982 [DE] Fed. Rep. of Germany ..... 3225965

[51] Int. Cl.[4] ..... D02G 1/00; D04B 19/00; D04B 35/22

[52] U.S. Cl. ..... 28/218; 66/125 A

[58] Field of Search ..... 28/218; 66/125 A

[56] References Cited

U.S. PATENT DOCUMENTS

| | | | |
|---|---|---|---|
| 3,184,820 | 5/1965 | Kanbar | 66/125 A |
| 3,623,311 | 11/1971 | Berger, Jr. | 66/125 A X |
| 3,939,637 | 2/1976 | Franz et al. | 57/140 R |

FOREIGN PATENT DOCUMENTS

| | | | |
|---|---|---|---|
| 11915 | 6/1980 | European Pat. Off. | 28/279 |
| 45-32379 | 10/1970 | Japan | 28/218 |
| 1346924 | 2/1974 | United Kingdom . | |
| 1387944 | 3/1975 | United Kingdom . | |

OTHER PUBLICATIONS

Kirk-Othmer, "Encyclopedia of Chemical Technology", Second Edition, vol. 9, pp. 156-157.

*Primary Examiner*—W. C. Reynolds
*Attorney, Agent, or Firm*—Connolly and Hutz

[57] ABSTRACT

The invention provides a process for the continuous successive drawing and texturizing of undrawn multifilament polyester yarns according to the knit/deknit process, wherein undrawn filaments or yarns having a high preorientation corresponding to a yield stress of above 7.5 cN/tex are continuously drawn at room temperature and immediately thereafter subjected to a known knit/deknit texturizing.

2 Claims, 1 Drawing Sheet

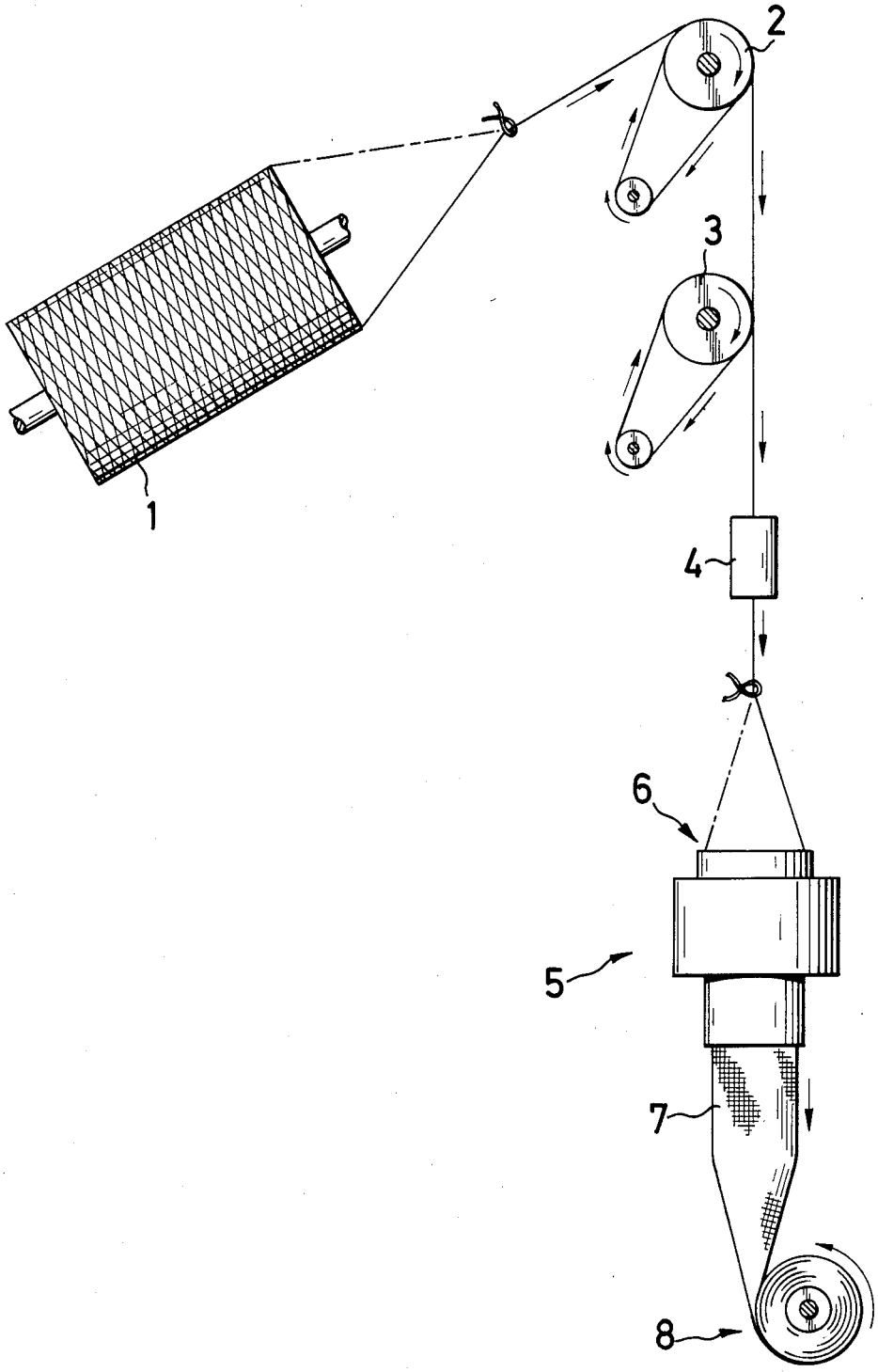
2
3
1
4
6
5
7
8

PROCESS FOR THE CONTINUOUS DRAWING AND TEXTURIZING OF FILAMENTS

The invention provides a process for the continuous successive drawing and texturizing of undrawn yarns; texturizing being carried out according to a known knit/deknit process.

For reasons of economy, texturized yarns of synthetic high polymers are mostly manufactured by draw-false twist texturizing of so-called pre-oriented yarns obtained by application of a high take-up speed in spinning. Such a process is described for example in German Offenlegungsschrift No. 2,211,843 (U.S. Pat. No. 3,939,637).

Alternatively to this false twist texturizing, the knit/-deknit process is applied for fashion effects, in which a smooth, drawn feed yarn is knit to form a hose or a web, this knit fabric is then set by a heat treatment and subsequently unravelled again. Under these conditions a texturized yarn is formed, because the individual filaments try to find the spatial position again which they had on setting of the knit fabric. The manufacture of the usually smooth yarn for the knit/deknit process by means of a conventional draw-twist process is expensive. Attempts have therefore been made to arrange a drawing step with heater before the knitter in order to obtain a regular drawing of the polyester yarns before they enter the knitter. However, by such integration of the drawing and knitting operations neither apparatus nor energy can be economized because drawing must be carried out as usual via heated bars, hotpins or heated godets. The advantage of such a process would be omission of a wind-up operation. However, this kind of process was not feasible in the industrial practice, because such a combination of operations causes trouble on standstill of the machines.

When drawing polyester filaments as usual, that is, with application of a heated device for exceeding the second order transition temperature, any standstill of a filament on the heater or heated device means an alteration of the dyeability as the minimum. The dyeability of a yarn reacts with a very high sensitivity to the duration of the thermal treatment, so that this process cannot produce uniform crimped yarns, or that great losses have to be put up with. Moreover, in the case of yarns a high total titer, for example plied yarns, homogeneous warming is ensured by long residence times in the heating zone only, and these residence times have to be maintained with precision.

In the drawing of synthetic filaments it is generally required to operate at temperatures above the second order transition temperature if a complete drawing of the filaments is to be obtained. This drawing is necessary in order to produce optimal textile properties in the filaments. In the case where polyester filaments are drawn without using a heater, a fraction only of the usual drawing values is attained without yarn break. Simultaneously, such cold drawing causes a considerable increase of the shrinkage values which are anyhow elevated. A heavily shrinking material can be subjected to a knit/deknit texturizing process with difficulty only, if at all, because hardenings or at least considerable irregularities inevitably occur on fixation of the knit fabric. For this reason, it has been proposed in German Offenlegungsschrift No. 2,017,971 (U.K. patent No. 1,346,924 to apply special expanding cones when setting the knit hoses. However, the use of such shaped articles complicates the texturizing process considerably; news on application of these expanding cones in the industrial practice has therefore not transpired.

A further possibility to combine knit/deknit texturizing and drawing is described in German Offenlegungsschrift No. 2,220,713 (U.K. patent No. 1,387,944). In this process, an undrawn yarn is directly knit, the knit fabrics in hose form are then subjected to drawing with simultaneous application of heat. It is however impossible to obtain a uniform drawing of the material under these conditions. From the above Offenlegungsschrift it can be taken that the yarns so manufactured have a dotted appearance after dyeing.

It was therefore still the object of the invention to combine the drawing of undrawn polyester yarns with the knit/deknit process in such a manner that crimped yarns which can be dyed even are obtained with low technological expenditure.

Surprisingly, it has been found that this object is achieved by a cold drawing immediately preceding the knitting of polyester yarns with the proviso that the polyester yarns have an especially high pre-orientation which is expressed hv a birefringence of more than $65\times10^{-3}$ or a yield stress of more than 7.5 cN/tex. Such polyester yarns are manufactured on conventional spinning plants at a take-up rate of more than 4,100, preferably more than 4,400 m/min. It has been found that with these very high pre-orientation values the otherwise necessary drawing of the polyester fibers under heat is no longer required. It has furthermore been observed that the knit hose can be easily handled on setting and that posterior deknitting of the knit fabric is possible without difficulty and without the use of special expanding pieces or similar devices.

By yield stress, there is to be understood the quotient of the yield force and the titer of the corresponding yarns. The yield force can be taken from the stress/-strain curve. Generally, there is a horizontal branch in such a curve after a linear ascending line (reversible range) and a peak at the yield point. In this range the length increases without simultaneous increase of force. The height of this yield zone is defined as yield force. In case of high pre-orientation the yield zone is condensed to a minimum, possibly a flex point or kink; however, the yield force can be determined in any case.

Cold drawing of the yarns, that is, drawing without external heating, can be carried out without difficulty immediately before knitting, because under these conditions varying residence times in the drawing zone on standstill or start of the machines have no noxious influence on the yarn properties.

The accompanying drawing demonstrates that for carrying out the process of the invention a conventional knitter needs to be complemented by a feed roll device (2) only. The delivery creel for the bobbin (1), the feed roll device (3), the knitter (5) as such with the needle cylinder (6) and the wind-up device (8) for the knit hose (7) remain unchanged.

According to the invention, the highly pre-oriented yarn is drawn in cold state (without external heating) between the feed roll devices (2) and (3), and subsequently knit. If desired, the filament bond can be increased further by an intermingling nozzle (4) between the drawing and the knitting zone.

The knit hoses obtained according to the process of the invention have uniform loops. Although a machine standstill shows in the general loop appearance of the knit hose (7), in the final crimped yarn however, that is, after setting and deknitting, it does not cause any irregularities of crimping or dyestuff absorption; so that it does not become manifest in the textile web made from the crimped yarn.

The process of the invention is especially advantageous in the processing of plied yarns. Even 6-fold plied yarns are capable of being uniformly drawn in the cold drawing step and subjected to a knit/deknit crimping. When processing plied yarns, intermingling immediately before the needle cylinder is of course especially recommended.

As demonstrated by the following Examples, the process of the invention produces yarns which correspond to the usual quality standards and are superior with respect to uniformity of yarn properties. A further advantage of the yarns manufactured according to the invention resides in their high dyestuff absorption which in general is considerably increased as compared to corresponding yarns obtained from the same polymer raw material in a conventional knit/deknit process.

A further advantage resides in energy savings, of course. Normally, before or on drawing, each filament or yarn must be passed over heated surfaces the energy losses of which are extraordinarily high. The estimate is that a very small amount only of the heating efficiency of each individual heater is transferred to the running filament or yarn, and that the remaining energy heats the room in which the machine is located. Since usually such rooms are air-conditioned, this means that the heating energy is destroyed again by the air-condition, thus causing further cost of energy.

The process of the invention is especially suitable for the processing of yarns made from polyethylene terephthalate, but can be applied of course for yarns made from other high molecular weight polyesters.

The following Examples illustrate the invention, parts and percentages being by weight unless otherwise stated.

Example 1

Polyethylene terephthalate having a relative viscosity of 1.81 (measured as 1.0% solution in phenol/tetrachloroethane in a ratio of 3:2) was melted and pressed through a spinneret having 32 holes to give filaments which after cooling were wound up at a rate of 4,500 m/min. The polyethylene terephthalate contained 0.04% of titanium dioxide as delusterant. The filaments had a titer of 200 dtex f 32 and a yield stress of 7.8 cN/tex and a heat shrinkage $S_{130}$ of 4.8% (the heat shrinkage $S_{130}$ was determined according to German Industrial Standard DIN 53866 in air having a temperature of 130° C).

The filament material so obtained was fed to a knit/deknit apparatus having a preceding drawing device according to the accompanying drawing, and the filaments were removed from the bobbins at a rate of 467 m/min. The filaments were drawn between the rollers (2) and (3) in a drawing ratio of 1:1.2 in cold state, that is, without the use of a heater. Due to the drawing, after the device (3) the yield stress of the filaments was 15 cN/tex at a heat shrinkage $S_{130}$ of 13%. The feed rate to the needle cylinder was 560 m/min. The needle cylinder had gauge 19"; a circular knit fabric having a length of 100 cm was manufactured by 240 needles in a raw, non-set state. After steaming in an autoclave at 130° C., a titer of 189 dtex was measured. The crimp shrinkage after deknitting of the set knit hose corresponded fully to the textile property requirements which knit/deknit texturized yarn has to meet especially with respect to the typical boucle structure of a yarn so texturized. After dyeing, the yarn proved to be dyed even in a very deep shade, that is, deeper as compared to samples manufactured according to the conventional process.

EXAMPLE 2 (Comparison)

From the same raw material as processed in Example 1 filaments having a titer of 242 dtex f 32 were manufactured at a wind-up rate of, however, 3,500 m/min only. This yarn had a yield stress of 5 cN/tex and a heat shrinkage $S_{130}$ of 45%. After cold drawing in a ratio of 1:1.45 in the same draw/knit device, a yield stress of 15 cN/tex and a heat shrinkage $S_{130}$ of 47.2% were measured before knitting. However, the knit hose obtained shrank to an extraordinary extent in steaming and had a boardy character. Although it was still possible to unravel the knit hose, the crimp structure was insufficient and especially the boucle character was missing. After deknit the effective titer was 210 dtex.

What is claimed is:

1. In a process for the drawing and texturizing of undrawn multifilament polyester yarns according to the knit/deknit process the improvement comprising the undrawn filaments or yarns having a high pre-orientation corresponding to a yield stress of above 7.5 cN/tex, the filaments or yarns being continuously drawn at room temperature and immediately thereafter subjected to a known knit/deknit texturizing.

2. The process as claimed in claim 1, wherein the fiber-forming substance of the feed yarns is polyethylene terephthalate.

* * * * *